United States Patent [19]

Jackson

[11] Patent Number: 4,754,135

[45] Date of Patent: Jun. 28, 1988

[54] QUADRUPLE FOCUSING TIME OF FLIGHT MASS SPECTROMETER

[75] Inventor: Thomas C. Jackson, Rochester, N.Y.

[73] Assignee: Eastman Kodak Company, Rochester, N.Y.

[21] Appl. No.: 31,340

[22] Filed: Mar. 27, 1987

[51] Int. Cl.[4] ..... H01J 49/40

[52] U.S. Cl. ..... 250/287; 250/294

[58] Field of Search ..... 250/287, 294, 396

[56] References Cited

U.S. PATENT DOCUMENTS 3,863,068 1/1975 Poschenrieder ..... 250/287

OTHER PUBLICATIONS

Poschenrieder, "Multipe-Focusing Time of Flight Mass Spectrometers Part I. TOFMS with Equal Momentum Acceleration", *International Journal of Mass Spectrometry and Ion Physics,* vol. 6, 1971, pp. 413–426.

Poschenrieder, "Multiple-Focusing Time of Flight Mass Spectrometers Part II. TOFMS with Equal Energy Acceleration", *International Journal of Mass Spectrometry and Ion Physics,* vol. 9, 1972, pp. 357–373.

Sakurai et al., "Ion Optics for Time-of-Flight Mass Spectrometers with Multiple Symmetry", *International Journal of Mass Spectrometry and Ion Processes,* vol. 63, 1985, pp. 273–287.

Sakurai et al., "A New Time-of-Flight Mass Spectrometer", *International Journal of Mass Spectrometry and Ion Processes,* vol. 66, 1985, pp. 283–290.

Sakurai et al., "Particle Flight Times in a Toroidal Condenser and an Electric Quadrupole Lens in the Third Order Approximation", *International Journal of Mass Spectrometry and Ion Processes,* vol. 68, 1986, pp. 127–154.

*Primary Examiner*—Craig E. Church
*Assistant Examiner*—Jack I. Berman
*Attorney, Agent, or Firm*—Carl C. Thomas

[57] ABSTRACT

A quadruple focusing time of flight mass spectrometer is disclosed comprised of a deflection zone including four separate focusing electrode pairs for each sequentially guiding ions through a deflection arc with limited divergence from a central reference plane. The focusing electrode pairs are arranged so that ions exit from the deflection zone in a direction opposite to that of their direction of entrance.

10 Claims, 5 Drawing Sheets

"Prior Art"

QUADRUPLE FOCUSING TIME OF FLIGHT MASS SPECTROMETER

FIELD OF THE INVENTION

This invention relates to time of flight mass spectrometers. It relates more particularly to quadruple focusing time of flight mass spectrometers.

BACKGROUND OF THE INVENTION

Time of flight (TOF) mass spectrometers have developed into well established analytical instruments for identifying materials based on a distribution (spectrum) of charged particles differing in mass created by pulsed radiant energy or particle bombardment. A sample of material whose spectrum is sought is mounted as a target in an electric field. Bombardment with accelerated particles, such as perfect gas atoms or ions, or high intensity electromagnetic radiation, disrupts the molecules of the target to create a variety of charged particles—e.g., molecular ions, fragments, cations, and/or anions—hereinafter collectively referred to as ions. Once an ion of the sample material is created, it is accelerated in the electric field toward an electrode of opposite charge. A portion of accelerated ions is allowed to pass through an aperture in the attracting electrode and embark on a flight path which, through creation of an ambient vacuum, can be of extended length.

When the target sample receives a bombardment pulse, parcels of ions of like polarity but differing in mass are generated. Given that each ion creating collision imparts the same momentum $$mv$$

where m is mass and v is velocity, it follows that ions of greater mass have a lower velocity. Since velocity is $$d/t$$

where d is distance and t is time, it follows that ions differing in mass within any single parcel will arrive at different times at a reference location along their common flight path. Stated another way, the original parcel of ions created by the bombardment pulse divides itself into partial parcels consisting of ions of the same mass and differing in mass from the ions of other partial parcels. By measuring and comparing the time of flight of partial parcels a spectrum of flight times can be identified which can then be mathematically translated into a mass spectrum unique to the sample material.

If all the ions in each partial parcel entered the flight path with exactly the same initial energy, then very compact (highly focused) partial parcels each consisting of ions of identical mass would be created. In practice there is a range of kinetic energies initially imparted to the ions within a partial parcel and this can lead to a range of flight times of ions within any given partial parcel that is broad enough to overlap flight time ranges of adjacent partial parcels.

The solution to this problem has been to provide a focusing deflection field in the flight path. The deflection field causes the partial parcels to traverse one or more arcs. In so doing, within each partial parcel the ions of higher kinetic energies in undergoing the same angular deflection traverse arcs of longer radii than ions of lower kinetic energies. Thus, the time required for ions of differing kinetic energies within each partial parcel to traverse the deflection field is evened out by the unequal arc paths. By locating the deflection field between time measurement reference locations in the flight path, usually referred to as entrance and exit planes, the result is to focus the partial parcels. Stated another way, the function of the deflection field is to make the flight time of ions in each partial parcel a function of the ratio of ion mass (m) to charge (e) rather than initial differences in kinetic energies.

As has been mathematically demonstrated to the satisfaction of those skilled in the art, quadruple focusing (four deflection arcs) are required to bring the partial parcels of ions exiting the deflection field into focus spatially (as measured along the three mutually perpendicular axes of space, usually referred to as X, Y, and Z axes), as well as in terms of elapsed time of flight (t), momentum (mv), and kinetic energy ($0.5mv^2$). In order to achieve focusing of the ions leaving the deflection field it is further necessary that the deflection arcs be chosen so that they are symmetrical with respect to a central point on the ion flight path within the deflection field.

A schematic diagram of a conventional quadruple focusing time of flight (QFTOF) mass spectrometer containing a deflection field is shown in FIG. 1. The mass spectrometer 100 is comprised of a central vacuum chamber 102 defining an ion flight path indicated by arrows 104 extending between an entrance plane 106 and an exit plane 108. The ambient pressure in the vacuum chamber is maintained below $1.33\times10^{-4}$ kilopascals ($<10^{-5}$ torr) to minimize ion collisions with the ambient atmosphere. There is located in the vacuum chamber between the dashed lines 110 and 112 a deflection zone 114. A pulsed ion source 116 emits a parcel of accelerated ions across the entrance plane into the flight path within the vacuum chamber. The ion source is also internally evacuated and can therefore be viewed as an extension of the flight path vacuum chamber. Beyond the exit plane there is located a receiving unit 118 for the ions traveling along the flight path. The receiving unit forms a second extension of the ion flight path vacuum chamber. By referencing the time at which receipt of a partial parcel is detected to the time a target pulse was generated in the ion source, a measurement of the time elapsed in traversing the flight path vacuum chamber between its entrance and exit planes can be provided.

The conventional QFTOF spectrometer shown in FIG. 1 focuses the partial parcels of ions by directing the flight path through four separate deflection arcs which are arranged to be symmetrical about a central point S in the flight path. Each of the deflection arcs lies in a common central reference plane with limited divergence of ions from the central reference plane being permitted.

PROBLEM TO BE SOLVED

The problem presented by conventional QFTOF mass spectrometers is that the requirement of four deflection arcs and a central point of symmetry in the flight path have forced constructions in which ions enter and leave the deflection zone travelling in the same direction. In this respect QFTOF mass spectrometers are similar to progenitor TOF mass spectrometers lacking focusing deflection fields.

The disadvantages of conventional mass spectrometer constructions are apparent by referring to FIG. 1. Since the electronic components of the spectrometer must lie at opposite ends of the flight path, they are separated by the intervening vacuum chamber 102. This renders the unit awkward to adjust and operate. It further precludes consolidation of electrical busses, access ports, and the like, which could be realized if the ion source 116 and receiving unit 118 were proximally located. Additionally, with ions entering and leaving the vacuum chamber 102 at opposite extremities, two vacuum seals, one with the ion source and one with the receiving unit are required. Further, with the vacuum chamber being inconveniently located between the ion source and receiving units, it is not attractive to lengthen the flight path, although it is apparent that lengthening the flight path increases elapsed times of flight and reduces the precision of flight time measurements required for accurate mass spectra determinations.

PRIOR ART

The following are illustrative of the prior state of the art:

R-1 Poschenrieder, "Multiple-Focusing Time of Flight Mass Spectrometers Part I. TOFMS With Equal Momentum Acceleration", *International Journal of Mass Spectrometry and Ion Physics,* Vol. 6, 1971, pp. 413–426.

R-2 Poschenrieder, "Multiple-Focusing Time of Flight Mass Spectrometers Part II. TOFMS With Equal Energy Acceleration", *International Journal of Mass Spectrometry and Ion Physics,* Vol. 9, 1972, pp. 357–373.

R-3 Poschenrieder U.S. Pat. No. 3,863,068, issued Jan. 28, 1975.

R-4 Sakurai et al, "Ion Optics for Time-of-Flight Mass Spectrometers with Multiple Symmetry", *International Journal of Mass Spectrometry and Ion Processes,* Vol. 63, 1985, pp. 273–287.

R-5 Sakurai et al, "A New Time-of-Flight Mass Spectrometer", *International Journal of Mass Spectrometry and Ion Processes,* Vol. 66, 1985, pp. 283–290.

R-6 Sakurai et al, "Particle Flight Times in a Toroidal Condenser and an Electric Quadrupole Lens in the Third Order Approximation", *International Journal of Mass Spectrometry and Ion Processes,* Vol. 68, 1986, pp. 127–154.

SUMMARY OF THE INVENTION

In one aspect this invention is directed to a quadruple focusing time of flight mass spectrometer comprised of (i) means including an entrance plane and an exit plane defining an ion flight path in which parcels of ions divide into partial parcels of equal effective mass, (ii) a pulsed ion source which emits a parcel of accelerated ions across the entrance plane into the flight path, and (iii) means for detecting the partial parcels of ions beyond the exit plane and recording their elapsed time of flight between the entrance and exit planes. The flight path defining means includes a deflection zone comprised of first, second, third, and fourth separate focusing means for each in sequence guiding the ions through a deflection arc with limited divergence from a central reference plane.

The invention is characterized in that the second and third focusing means share a common central reference plane which is perpendicular to central reference planes of the first and fourth focusing means and the first and second focusing means define a first segment of the ion flight path in the deflection zone which is a mirror image of a second segment of the ion flight path formed by the third and fourth focusing means, so that ions enter and exit from the deflection zone traveling in opposite directions.

The QFTOF mass spectrometers of the present invention provide for the first time a QFTOF mass spectrometer construction in which the ion source and detection units can be proximally located if not at least partially integrated. This permits simplification and consolidation of structure. It also is a convenience in initial adjustment and in operation. For example, one operator can simultaneously inspect both the ion source and detection portions of the apparatus. Further, the construction of the vacuum chamber defining the flight path can be highly simplified. The vacuum chamber can be constructed with one closed end so that only one vacuum seal is necessary. Additionally, the length of the flight path in the vacuum chamber can be greatly elongated without complicating adjustment or operation of the apparatus.

BRIEF DESCRIPTION OF THE DRAWINGS

Other advantages of the QFTOF mass spectrometers of the invention can be more fully appreciated by reference to the following detailed description considered in conjunction with the drawings, wherein.

DESCRIPTION OF PREFERRED EMBODIMENTS

Figure 2:
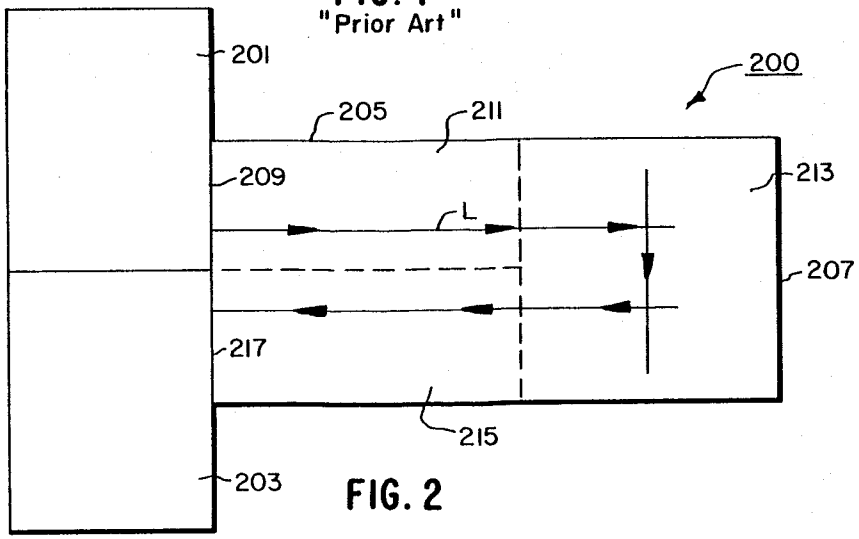
FIG. 2 is a schematic diagram of a QFTOF mass spectrometer according to the present invention.

A QFTOF mass spectrometer 200 according to the present invention is shown in FIG. 2. A pulsed ion source 201 and an ion detection unit 203 are located in proximity. A vacuum chamber 205 having a closed end 207 is in sealed contact with the source and detection units. An ion flight path L lies within the vacuum chamber extending from an entrance plane 209 through a predeflection flight path zone 211, a deflection zone 213, and a return flight path zone 215 to an exit plane 217.

Figure 3:
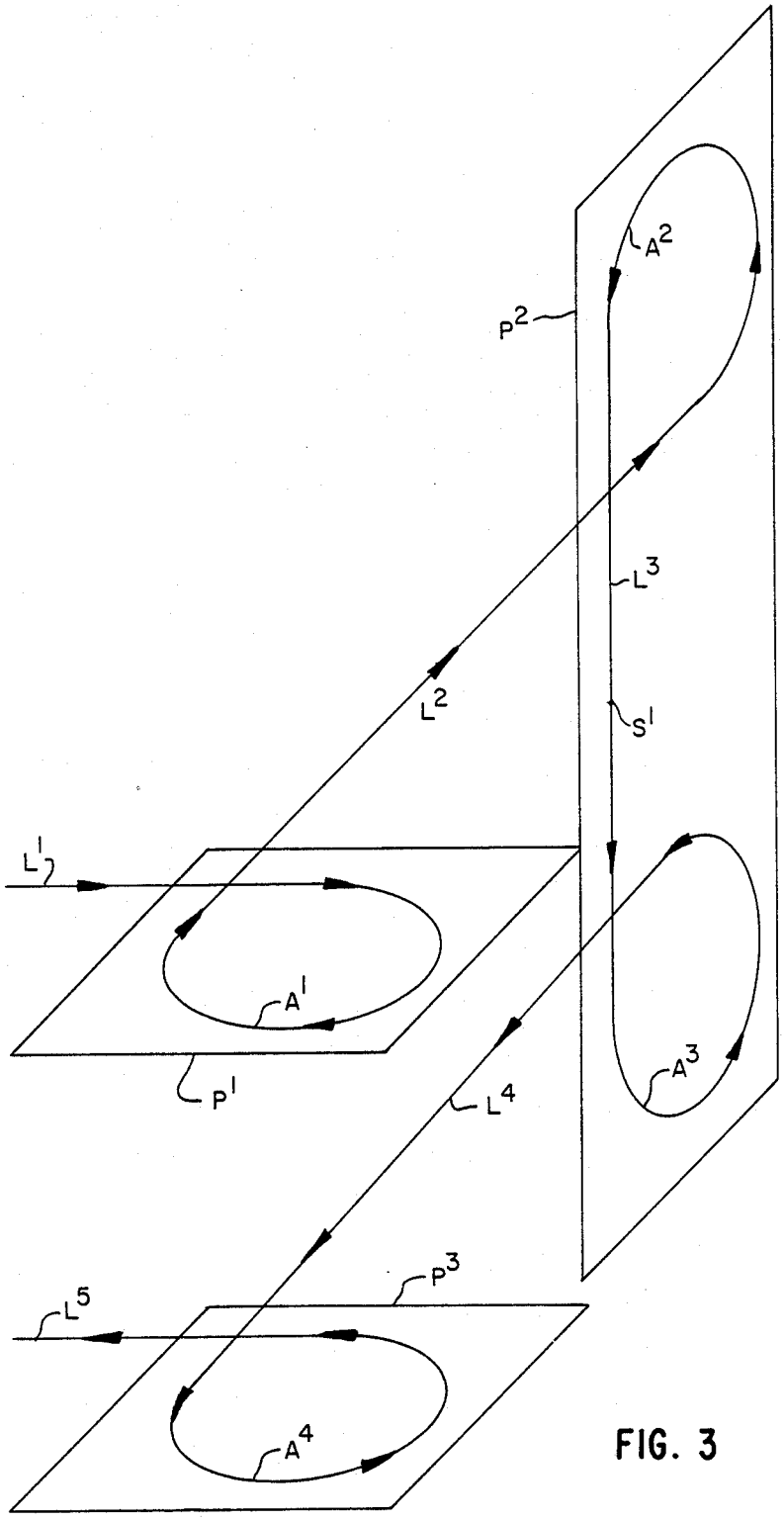
FIG. 3 is an oblique view of the ion flight paths in the central reference planes of the four focusing units.
Figure 4:
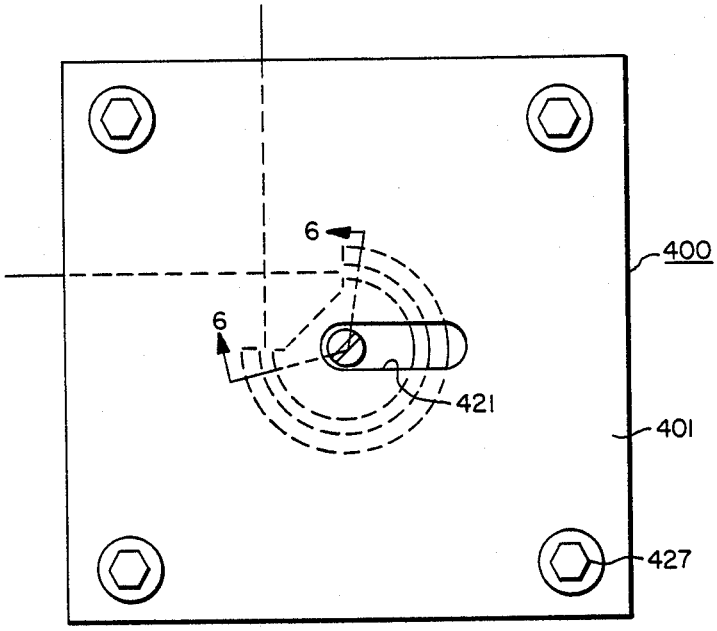
FIG. 4 is a plan view of a preferred focusing unit.
Figure 5:
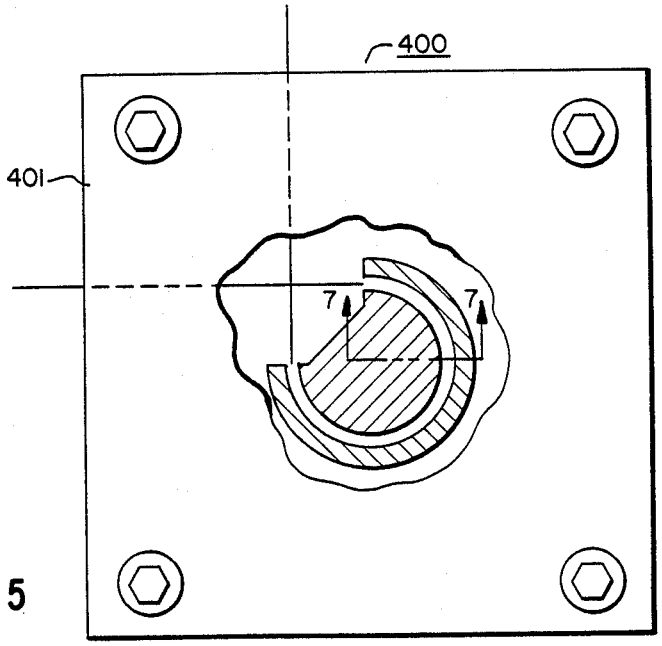
FIG. 5 is a view similar to FIG. 4, but with portions shown in section.
Figure 6:
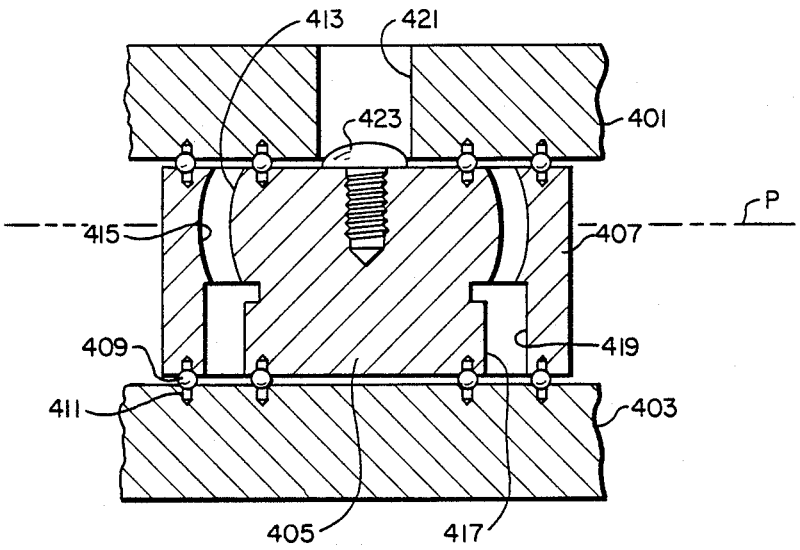
FIG. 6 is a section taken along section line 6—6 in FIG. 4.
Figure 7:
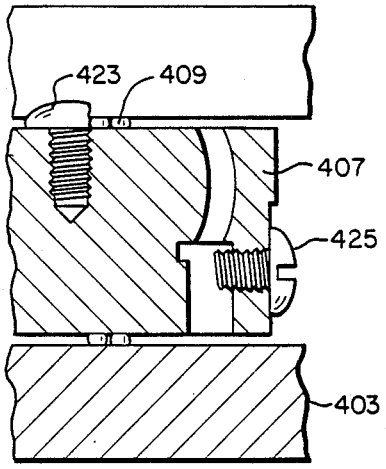
FIG. 7 is a section taken along section line 7—7 in FIG. 5.

The flight path of the ions in the deflection zone is best appreciated by reference to FIG. 3. There are within the deflection zone four separate focusing units for sequentially guiding the ions through a deflection arc with limited divergence from a central reference plane. The focusing units themselves are omitted from FIG. 3 so that the deflection arcs and central reference planes of the focusing units can be better viewed. As shown, a central reference plane $P^1$ of the first focusing unit receives ions traveling along incoming ion flight path $L^1$, deflects the ions through an arc $A^1$ lying in the reference plane, and directs the ions along a second flight path $L^2$ to the second focusing unit. The second focusing unit receives the ions on the flight path $L^2$ in a central reference plane $P^2$, deflects the ions through an arc $A^2$ lying in the second reference plane, and directs the ions along a third flight path $L^3$ to a third focusing unit. The third focusing unit is oriented to have a central reference plane common to the second focusing unit—i.e., the second and third focusing units share reference plane $P^2$. The third focusing unit receives ions following flight path $L^3$, deflects the ions through an arc $A^3$, and directs the ions to the fourth focusing unit along flight path $L^4$. The fourth focusing unit receives the ions following flight path $L^4$ in central reference plane $P^3$, deflects the ions through an arc $A^4$ and directs the ions toward the exit plane along flight path $L^5$. While deviation of the flight paths of individual ions above and below the central reference planes occurs, these deviations are small.

The relative orientations of the focusing units required to achieve the advantages of the present invention are apparent in FIG. 3. Ions enter the deflection zone along flight path $L^1$ and exit along flight path $L^5$, which is offset from and counter to the direction of entry. In other words, the direction of ion flight undergoes an angular reversal and lateral displacement in the deflection zone. This advantageous effect is achieved orienting the focusing units so that said first and second focusing means define a first segment of the ion flight path in said deflection zone which is a mirror image of a second segment of the ion flight path formed by said third and fourth focusing means, the flight path in the deflection zone can be viewed as two symmetrical segments, one segment extending from the point of entry of the ions into the deflection zone to the point S' and the second segment extending from the point S' to point of exit of the ions from the deflection zone. In addition to being symmetrical the two segments are mirror images. Stated another way, the first and second focusing units generate ion flight paths (including deflection arcs) which are mirror images of those generated by the third and fourth focusing units, respectively. An important contribution to achieving this relationship is the orientation of the first and fourth focusing units in separate reference planes with these reference planes perpendicularly intersecting the reference common reference plane of the second and third focusing units. The orientation of the focusing units in three separate reference planes is, of course, a significant departure from the prior state of the art, wherein all four focusing units are mounted in a common reference plane.

Figure 1:
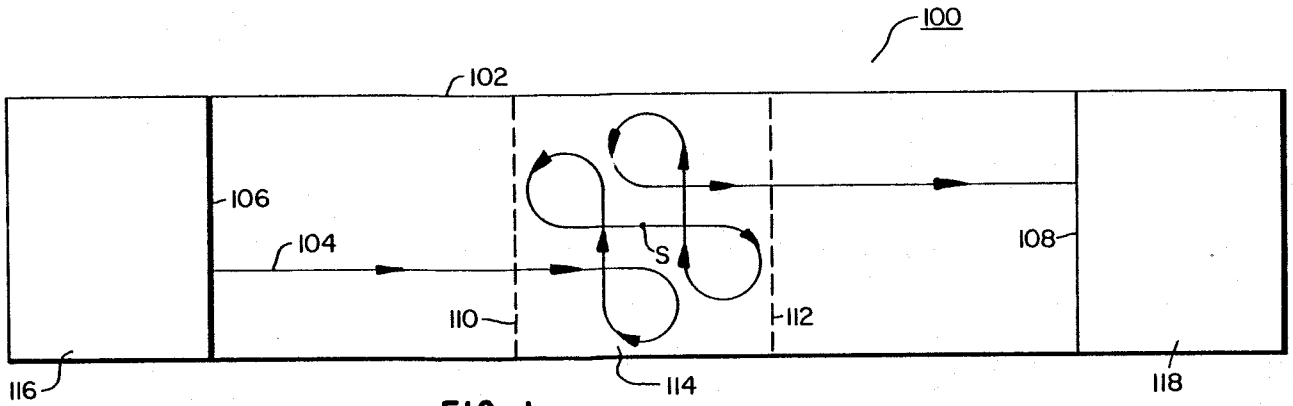
FIG. 1 is a schematic diagram of a conventional QFTOF mass spectrometer.

The arrangement shown in FIG. 3 is the preferred arrangement, since each of the arcs $A^1$, $A^2$, $A^3$, and $A^4$ are equal. From mathematical analysis it is known that four identical 269° deflection arcs are ideal for QFTOF mass spectrometers. In practice deflection angles of approximately 269° (269°±2°) are common in QFTOF mass spectrometers. It is to be noted that the lines of flight $L^1$ and $L^5$ are parallel when each of the deflection arcs $A^1$, $A^2$, $A^3$, and $A^4$ are equal, regardless of the specific angle chosen. For example, parallel incoming and exit lines of flight are possible with ideal deflection arcs of exactly 269° C. as well as with deflection arcs of only approximately 269°. Note that in FIG. 1 four identical deflection arcs must be 270° each for the incoming and exit lines of flight to be parallel. It is possible to lengthen or shorten the arcs $A^2$ and $A^3$ by equal amounts while still preserving mirror image symmetry and parallel entrance and exit lines of flight. Similarly, it is possible to lengthen or shorten the arcs $A^1$ and $A^4$ by equal amounts while still preserving mirror image symmetry and parallel entrance and exit lines of flight. While these and similar variations are specifically contemplated, it is preferred for ease of construction and accuracy of focusing that all of the focusing units be identical in their deflection arc (including both the angular extent of the arc and its radius).

The individual focusing units can be of any convenient conventional construction. Typically a pair of focusing electrodes are constructed of an inner electrode presenting an inner ion guiding surface and an outer electrode providing a spaced outer ion guiding surface. The two ion guiding surfaces are cylindrical over the desired deflection arc. In use, ions traveling along a linear flight path enter the space between the inner and outer electrodes. The ions in the flight path all exhibit the same charge polarity. In addition they exhibit a range of kinetic energies above and below an average value. The inner and outer electrodes are electrically biased to exhibit the same polarity as the ions. The voltage applied to the outer electrode is higher than that applied to the inner electrode. The voltages can be selected by known relationships to allow ions of average kinetic energy to traverse the arc defined by the spaced electrodes along a flight path mid-way between the opposed inner and outer ion guiding surfaces. The ions are deflected and guided by charge repulsion. Ions of slightly higher than average kinetic energies must approach the outer ion guiding surface somewhat more closely to be repelled and therefore traverse an arc of a slightly longer than average radius. Conversely, ions of slightly lower than average kinetic energies are repelled from the outer electrode ion guiding surface more readily and traverse an arc having a somewhat shorter than average radius. This contributes to focusing partial parcels of ions, as described above.

The preferred focusing units of the present invention are constructed according to the teachings of commonly assigned, concurrently filed R. S. Gohlke U.S. Ser. No. 031,297, titled TIME OF FLIGHT MASS SPECTROMETER WITH IMPROVED DEFLECTION FIELD. FIGS. 4 through 7 illustrate a preferred focusing unit 400. Between a pair of mounting plates 401 and 403 are mounted an inner and outer focusing electrodes 405 and 407. The electrodes are electrically isolated from the mounting plates by being supported on insulative beads 409 seated in aligned recesses 411 in the mounting plates and electrodes. The inner and outer electrodes provide inner and outer ion guiding surfaces 413 and 415, respectively, symmetrically traversing a central reference plane P. The inner and outer ion guiding surfaces converge toward their upper and lower edges and, conversely, are most widely spaced in the reference plane.

Below its ion guiding surface the inner electrode is provided with a mounting spindle 417 which can be of any convenient shape. The outer electrode below its ion guiding surface is internally recessed at 419 to increase its spacing from the inner electrode.

The upper mounting plate 401 is provided with a slot 421 over the inner electrode to permit access to a lead attachment screw 423 threaded into the inner electrode.

A lead mounting screw 425 is threaded into the outer electrode. Bolts 427 are employed to compress the mounting plates against the electrodes, thereby holding the electrodes in their desired spatial arrangement.

The portions of the inner and outer electrodes below their ion guiding surfaces are mere conveniences of construction and are not required. If desired, the ion guiding surfaces can extend from the top to the bottom of both the inner and outer electrodes. The mounting plates in the preferred deflection field unit are grounded. The mounting plates, being electrically isolated from both electrodes can, if desired, be biased to serve as conventional field plates, but this is not required, since the curvature of the ion guiding surfaces can be entirely relied upon to prevent ion escape from the deflection fields. The use of mounting plates to locate the electrodes in position is not required, since the availability of alternative mounting arrangements can be readily appreciated.

A significant advantage of the focusing unit 400 for conventional focusing units is attributed to the inner and outer electrodes having spaced opposed ion guiding surfaces which are curved in planes normal to the ion flight path. Specifically, the inner electrode presents an ion guiding surface which is convex in planes normal to the ion flight path while the outer electrode presents an ion guiding surface which is concave in planes normal to the ion flight path. In addition, in planes normal to the ion flight path, the inner and outer electrode ion guiding surfaces are more closely spaced at their edges than mediate their edges.

Figure 8:
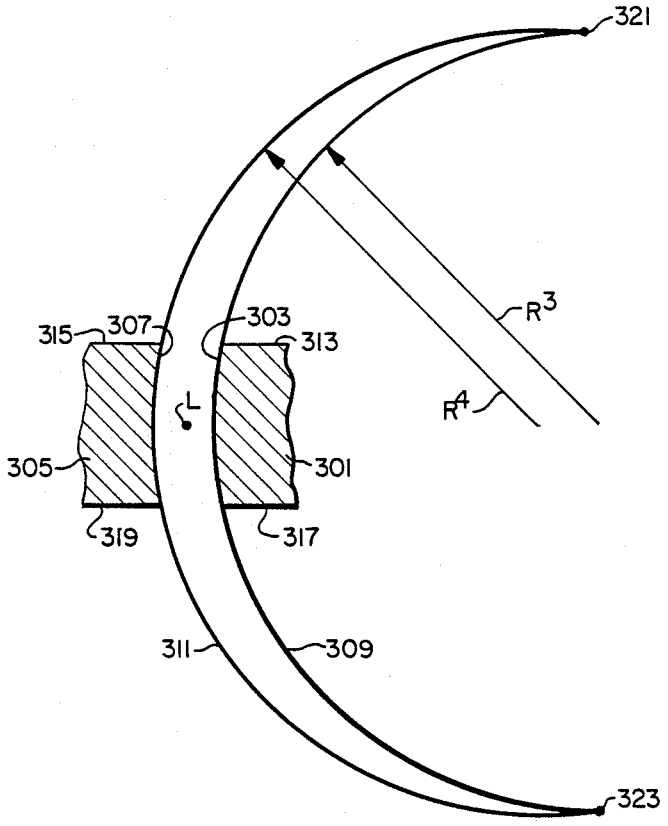
FIG. 8 is a schematic sectional detail of spaced electrode curved ion guiding surfaces taken along a plane normal to the ion flight path.

A preferred embodiment of inner and outer electrodes satisfying the ion guiding surface configuration of the invention is shown in FIG. 8. Inner electrode 301 is shown providing an inner ion guiding surface 303 while spaced outer electrode 305 is shown providing an outer ion guiding surface 307. In the specific form shown the inner ion guiding surface is defined by the perimeter of a sphere 309 partially shown in section having a radius $R^3$. The outer ion guiding surface of the outer electrode is defined by the perimeter of an ellipsoid in this instance as oblate sphere 311 partially shown in section. The minor radius of curvature $R^4$ of the ellipsoid or oblate sphere is equal to the radius of curvature of the sphere. Although not easily observed by casual inspection, the opposed upper edges 313 and 315 of the inner and outer electrodes as well as the opposed lower edges 317 and 319 of the these electrodes are closer together than other portions of the inner and outer ion guiding surfaces. This can be visually confirmed merely by noting that the surfaces of the sphere and oblate sphere merge at their upper extremity 321, diverge smoothly until reaching the level of the ideal ion flight path L equally spaced from the upper and lower edges of the inner and outer electrodes, and then converge smoothly toward their common lower extremity 323.

The manner in which the curvature of the ion guiding surfaces prevents straying and loss of ions can be appreciated by comparing conventional cylindrical ion guiding surfaces. There are an infinite number of planes of uniform potential separating these concentric parallel cylindrical ion guiding surfaces. Any ion following a flight path vector lying in one of these uniform potential planes can escape from the deflection field between the cylindrical ion guiding surfaces without encountering any electrical restraint. However, viewing FIG. 8, it is apparent that the curved shape of the opposed ion surfaces precludes any plane of uniform potential being present between the electrodes. To graphically illustrate this, it is apparent that in FIG. 8 no flight vector lying in a plane of equal potential can be drawn emanating from flight path L (or any other selected point in the space between the ion guiding surfaces). Further, the higher field gradients produced by the reduced spacings of the upper and lower edges of the ion guiding surfaces constitute potential barriers to escape of ions from the deflection field. Ion containment by the ion guiding surfaces can be illustrated by considering an ion at point L having a vertical radial vector of flight. As the vertical component of flight seeks to move the ion either up or down from the point L, a higher repelling force from the outer electrode is encountered which acts to deflect the ion back toward its initial central location.

In the embodiment of FIG. 8 inner ion guiding surface has a radius of curvature $R^3$ which is equal to the radius of curvature $R^4$ of the outer ion guiding surface. The desired reduced edge spacing of the ion guiding surfaces can be realized so long as the radius of curvature $R^3$ is equal to or greater than the radius of curvature $R^4$. As described above the inner ion guiding surface conforms to the periphery of a sphere while the outer ion guiding surface conforms to the periphery of an oblate sphere, where $R^4$ is the minor radius of the oblate sphere. An alternative relationship is for the outer ion guiding surface to be a spherical section with the inner ion guiding surface being formed by the major radius of an ellipsoid. Further, neither spherical nor ellipsoidal surface geometries are required. So long as the edge spacing relationship is satisfied any other convenient curved ion guiding surface configuration can be employed. For example, such surface can be generated by the rotation of a parabola, catenary, or other conveniently mathematically generated curve about an axis.

While it is preferred to employ four focusing units 400 within curved ion guiding surfaces as described above in combination, it is recognized that the advantages of curved ion guiding surfaces can be at least partially realized with only one of the focusing units being so constructed with the remaining focusing units having conventional cylindrical ion guiding surfaces. Such conventional units can, for example, be constructed identically to those of the focusing unit 400, differing only in having cylindrical ion guiding surfaces 413 and 415. Referring back to FIG. 3, it is to be further noted that even if all four of the focusing units were constructed with cylindrical ion guiding surfaces, the 90° rotation of the second focusing unit with respect to the first focusing unit and the 90° rotation of the fourth focusing unit with respect to the third focusing unit is in itself capable of reducing ion straying from the deflection fields.

The invention has been described in detail with particular reference to preferred embodiments thereof, but it will be understood that variations and modifications can be effected within the spirit and scope of the invention.

What is claimed is:

1. A quadruple focusing time of flight mass spectrometer comprised of means including an entrance plane and an exit plane defining an ion flight path in which parcels of ions divide into partial parcels of equal effective mass, a pulsed ion source which emits a parcel of accelerated ions across said entrance plane into the flight path, and means for detecting the partial parcels of ions beyond said exit plane and recording their elapsed time of flight between said entrance and exit planes, said flight path defining means including a deflection zone comprised of first, second, third, and fourth separate focusing means for each in sequence guiding the ions through a deflection arc with limited divergence from a central reference plane, characterized in that said second and third focusing means share a common central reference plane which is perpendicular to central reference planes of said first and fourth focusing means and said first and second focusing means define a first segment of the ion flight path in said deflection zone which is a mirror image of a second segment of the ion flight path formed by said third and fourth focusing means, so that ions enter and exit from said deflection zone traveling in opposite directions.

2. A quadruple focusing time of flight mass spectrometer according to claim 1 further characterized in that said first and fourth focusing means each guide ions through a first deflection arc while said second and third focusing means each guide ions through a second deflection arc.

3. A quadruple focusing time of flight mass spectrometer according to claim 2 further characterized in that said four focusing means all guide ions through a deflection arc of approximately 269°.

4. A quadruple focusing time of flight mass spectrometer according to claim 3 further characterized in that said four focusing means all guide ions through a deflection arc of exactly 269°.

5. A quadruple focusing time of flight mass spectrometer according to claim 1 further characterized in that said focusing means are each comprised of a pair of inner and outer electrodes presenting spaced opposed ion guiding surfaces.

6. A quadruple focusing time of flight mass spectrometer according to claim 1 further characterized in that, in planes normal to the ion flight path, said inner electrode ion guiding surface is convex and said outer electrode ion guiding surface is concave.

7. A quadruple focusing time of flight mass spectrometer according to claim 6 further characterized in that, in planes normal to the ion flight path, said ion guiding surfaces of said inner and outer electrodes are more closely spaced at their opposed edges than mediate their edges.

8. A quadruple focusing time of flight mass spectrometer according to claim 5 wherein one of said said inner and outer ion guiding surfaces lies along the periphery of a sphere.

9. A quadruple focusing time of flight mass spectrometer according to claim 8 wherein one remaining of said inner and outer ion guiding surfaces lies along the periphery of an ellipsoid.

10. A quadruple focusing time of flight mass spectrometer according to claim 5 wherein at least one of said focusing means includes plates lying parallel to its central reference plane located adjacent and spaced from edges of the ion guiding surfaces.

* * * * *